US005934302A

United States Patent [19]

Nemelka

[11] Patent Number: 5,934,302

[45] Date of Patent: Aug. 10, 1999

[54] CONTROL VALVE APPARATUS AND METHOD FOR REGULATING FLUID FLOW IN FLUID-INTAKE MACHINES

[76] Inventor: Mark S. Nemelka, 3258 W. Sunset Ct., Riverton, Utah 84605

[21] Appl. No.: 08/640,575

[22] Filed: May 1, 1996

[51] Int. Cl.[6] ..... F16K 37/00

[52] U.S. Cl. ..... 137/1; 137/78.1; 137/80; 137/312; 137/487.5; 137/613

[58] Field of Search ..... 137/1, 486, 487.5, 137/78.1, 312, 80

[56] References Cited

U.S. PATENT DOCUMENTS

| | | | |
|---|---|---|---|
| 3,416,560 | 12/1968 | Bruno . | |
| 4,297,686 | 10/1981 | Tom | 137/78.1 |
| 4,659,909 | 4/1987 | Knutson . | |
| 4,877,049 | 10/1989 | Fornassari | 137/312 |
| 5,000,224 | 3/1991 | Olson, Jr. et al. . | |
| 5,004,014 | 4/1991 | Bender . | |
| 5,038,820 | 8/1991 | Ames et al. . | |
| 5,086,806 | 2/1992 | Engler et al. | 137/486 |
| 5,139,044 | 8/1992 | Otten et al. | 137/80 |
| 5,209,454 | 5/1993 | Engdahl et al. . | |
| 5,251,148 | 10/1993 | Haines et al. . | |
| 5,267,587 | 12/1993 | Brown | 137/624.12 |
| 5,402,815 | 4/1995 | Hoch, Jr. et al. | 137/80 |
| 5,409,037 | 4/1995 | Wheeler et al. | 137/551 |
| 5,411,052 | 5/1995 | Murray . | |
| 5,441,070 | 8/1995 | Thompson | 137/1 |
| 5,638,847 | 6/1997 | Hoch, Jr. et al. | 137/312 |

*Primary Examiner*—A. Michael Chambers
*Attorney, Agent, or Firm*—Thorpe, North & Western, L.L.P.

[57] ABSTRACT

A control valve system. The system includes a microcontroller electronically connectable to the power supply of an electrical household appliance, such as a washing machine which is connected to the water piping system in a building via hoses. The microcontroller produces first and second electrical signals representing a presence and an absence of electron flow in the power supply. Solenoid valves are responsive to the signals for releasing fluid flow to the hoses responsive to the first electrical signal and blocking the fluid flow responsive to the second electrical signal.

7 Claims, 2 Drawing Sheets

CONTROL VALVE APPARATUS AND METHOD FOR REGULATING FLUID FLOW IN FLUID-INTAKE MACHINES

BACKGROUND OF THE INVENTION

1. The Field of the Invention

The present invention relates generally to control valve systems. More particularly, it concerns an electronically actuated shut-off valve system for use in connection with fluid-intake appliances such as washing machines.

2. The Background Art

It will be appreciated that conventional clothes washing machines are usually connected to faucets of a water piping system in a building via flexible intercoupling conduit or hose. Two hoses are typically used for hot and cold water, respectively. Users open the faucets of the piping system when the washing machine is installed, often leaving the faucets open throughout the duration of the washing machine's life. As such, water pressure remains continuously in the hoses.

If the hoses develop a leak or otherwise fail, the water simply floods from the leak into the house or apartment until noticed. It is often half a day or more before such hose failures are noticed, resulting in extensive water damage to the household interior, especially carpets and wallboard. Wallboard damage is particularly extensive when the washing machine resides on a second level or higher in the building.

OBJECTS AND SUMMARY OF THE INVENTION

It is an object of the present invention to provide a control valve system for automatically blocking water flow to intercoupling conduit of a fluid-intake appliance during periods of nonuse.

It is another object of the present invention, in accordance with one aspect thereof, to provide such a control valve system which operates responsive to electronic control signals.

It is a further object of the present invention, in accordance with one aspect thereof, to provide such a control valve system which operates responsive to fluid pressure differential in the intercoupling conduit of the appliance.

It is an additional object of the present invention, in accordance with one aspect thereof, to provide such a control valve system which operates responsive to fluid flow rate differential in the intercoupling conduit of the appliance.

It is an additional object of the present invention, in accordance with one aspect thereof, to provide such a control valve system which operates responsive to moisture-sensing of areas external to the appliance.

The above objects and others not specifically recited are realized in a specific illustrative embodiment of a control valve system. The system includes a microcontroller electronically connectable to the power supply of an electrical household appliance, such as a washing machine which is connected to the water piping system in a building via hoses. The microcontroller produces first and second electrical signals representing a presence and an absence of electron flow in the power supply. Solenoid valves are responsive to the signals for releasing fluid flow to the hoses responsive to the first electrical signal and blocking the fluid flow responsive to the second electrical signal.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
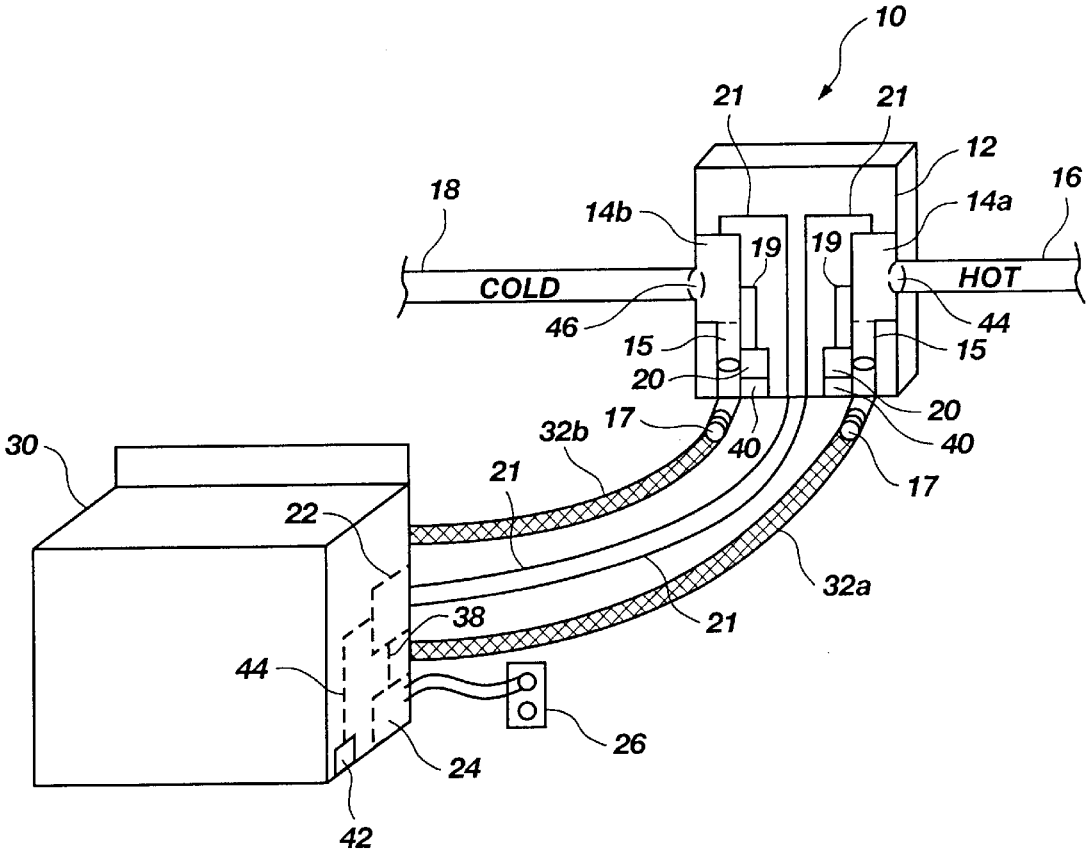
FIG. 1 is a perspective view of a control valve system, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

The invention comprises a control valve system, designated generally at 10 in FIG. 1. The system 10 includes a housing 12 configured for attachment to the hot and cold water pipes 16 and 18, respectively, of a household water system. The system 10 also includes solenoid valves 14*a* and 14*b* which are respectively disposed in fluidic communication with the hot and cold water pipes 16 and 18. Fluid channels 15 extend from the solenoid valves 14*a* and 14*b* to a pair of faucets 17, as shown. Pressure sensor means (hereinafter "pressure sensors") 20 are disposed in fluid communication with the fluid channels 15.

The pressure sensors 20 are electrically connected to the solenoid valves 14*a* and 14*b* via leads 19. The solenoid valves 14*a* and 14*b* are electrically connected to a control circuit means 22, such as a microcontroller, via electrical connectors 21. The control circuit means 22 is connected to a power supply 24 of the washing machine 30 via lead 38, and the washing machine 30 is connectable to the household electrical outlet 26.

In use, the solenoid valves 14*a* and 14*b* open and close responsive to electrical signals (not shown) produced by the control circuit means 22. The control circuit means 22 is programmed to signal the solenoid valves 14*a* and 14*b* to remain closed, until the power supply 24 begins operating the washing machine 30. When the washing machine 30 is actuated, the control circuit means 22 signals the solenoid valves 14*a* and 14*b* to open, such that water supply is provided to fluid passages or hoses 32*a* and 32*b* during the operation of the washing machine 30. The fluid passages or hoses 32*a* and 32*b* might also be referred to as "conduit." Further and as indicated by the depiction of the washing machine 30 in FIG. 1, it is understood by those of ordinary skill in the field that washing machines such as item 30 include internal valves (not shown) disposed therein, positioned in communication with the fluid passages or hoses 32*a* and 32*b* and thus on respectively downstream sides of said hoses, each of said internal valves thereby cooperatively forming a "serial flowpath" in conjunction with the valves 14*a* and 14*b*, respectively, since said valves 14*a* and 14*b* are positioned on an upstream side of the fluid passages or hoses 32*a* and 32*b*, respectively.

The control circuit means 22 is responsive to electron flow in the power supply 24, in any suitable manner. For example, it is possible that some kind of electron flow will always be present in the power supply 24, such as to power a clock, but there would still be an absence of electron flow in one of the leads within the power supply 24 which operates to activate and deactivate the washing machine 30. An absence of electron flow as contemplated herein thus corresponds to deactivation of the washing machine 30, in that some portion of the power supply 24 would be characterized as having an absence of electron flow even though other parts of the power supply might retain electron flow therein.

There is thus little or no water pressure in the hoses 32 at any time during periods when the washing machine 30 is not actually operating. This aids in preventing the common scenario of the hoses 32 breaking and flooding the house or apartment, which can be especially devastating if it occurs during a vacation or other period when the owner of the household is not present for a number of days.

The pressure sensors 20 are optional, and are configured and arranged to sense the water pressure within the fluid channels 15, and thus also within the hoses 32. Conventional washing machines only receive water flow at about one-third or some other fraction of the amount of available water pressure in the pipes 16 and 18. Accordingly, if the hoses 32 break or fail such that water floods therefrom, the pressure sensors 20 can sense the lower pressure and signal the solenoid valves 14*a* and 14*b* to close.

The pressure sensors 20 therefore provide an added check which aids in preventing flooding from occurring even during periods when the washing machine 30 is operating. For example, if the hoses 32 failed after the washing machine 30 began an operating cycle, the solenoid valves 14*a* and 14*b* would not be signaled by the control circuit means 22 to close until the cycle was finished. In such a case, the pressure sensors 20 could sense the resulting lower water pressure within water channels 15 and signal the solenoid valves 14*a* and 14*b* to close.

Also optional are flow sensor means (hereinafter "flow sensors") 40, which may be used either in lieu of, or in addition to, the pressure sensors 20. The flow sensors 40 are configured and arranged to sense the water flow rate within the fluid channels 15, and thus also within the hoses 32. Again, conventional washing machines only receive water flow at about one-third or some other fraction of the amount of available water pressure in the pipes 16 and 18. Accordingly, if the hoses 32 break or fail such that water floods therefrom, the flow sensors 40 can sense the higher flow rate and signal the solenoid valves 14*a* and 14*b* to close.

The flow sensors 40 therefore provide an added check which aids in preventing flooding from occurring even during periods when the washing machine 30 is operating. For example, if the hoses 32 failed after the washing machine 30 began an operating cycle, the solenoid valves 14*a* and 14*b* would not be signaled by the control circuit means 22 to close until the cycle was finished. In such a case, the flow sensors 40 could sense the resulting higher flow rate within water channels 15 and signal the solenoid valves 14*a* and 14*b* to close.

Also optional is a moisture sensor means 42 attachable to the exterior of the washing machine 30 for producing an electrical signal representing a presence of moisture. If flooding occurs in the vicinity of the washing machine 30, such as through a leak in the hoses 32, the moisture sensor means 42 will sense the flooding and transmit a signal to the control circuit means 22 to close the valves 14*a* and 14*b*.

The housing 12 has first and second openings 44 and 46 formed therein for communicating respectively with the pipes 16 and 18, and with the hoses 32. It is to be understood that the term "communicate" as used herein shall refer broadly to fluidic communication, as well as to the concept of channels such as the pipes 16 and 18 which might extend through the openings 44 and 46 but which are hermetically sealed with respect to those openings. The pressure sensors 20 and flow sensors 40 are disposed on the housing 12, which shall be construed broadly to refer to sensors 20 and 40 being mounted either inside or outside of the housing 12.

It is to be understood that the system 10 could be applied to any liquid-intake machine, including the clothes-washing machine 30, a dishwashing machine, or any machine which utilizes liquid. It is also to be understood that some embodiments in accordance with the principles of the present invention need not require the control circuit means 22 to be responsive to electron flow in the power supply 24, but could instead be configured and arranged to be responsive to some other signaling device, such as a timer, pressure sensor, flow sensor, moisture sensor, or any suitable signaling device.

It is preferable to position the valves 14*a* and 14*b* externally of the washing machine 30 and the hoses 32, such that a fluid movement path extends sequentially from the pipes 16 and 18 through the hoses 32 and into the washing machine 30. It is to be understood that acceptable pressure ranges and flow rate ranges with respect to the hoses 32*a* and 32*b* may be the same, or different. As such, a pressure sensor or a fluid sensor responsive to conditions in hose 32*a* could be configured to close the valve 14*a* at responsive to threshold pressure or flow rate levels which are identical to threshold levels in hose 32*b*, or which are different.

Figure 2:
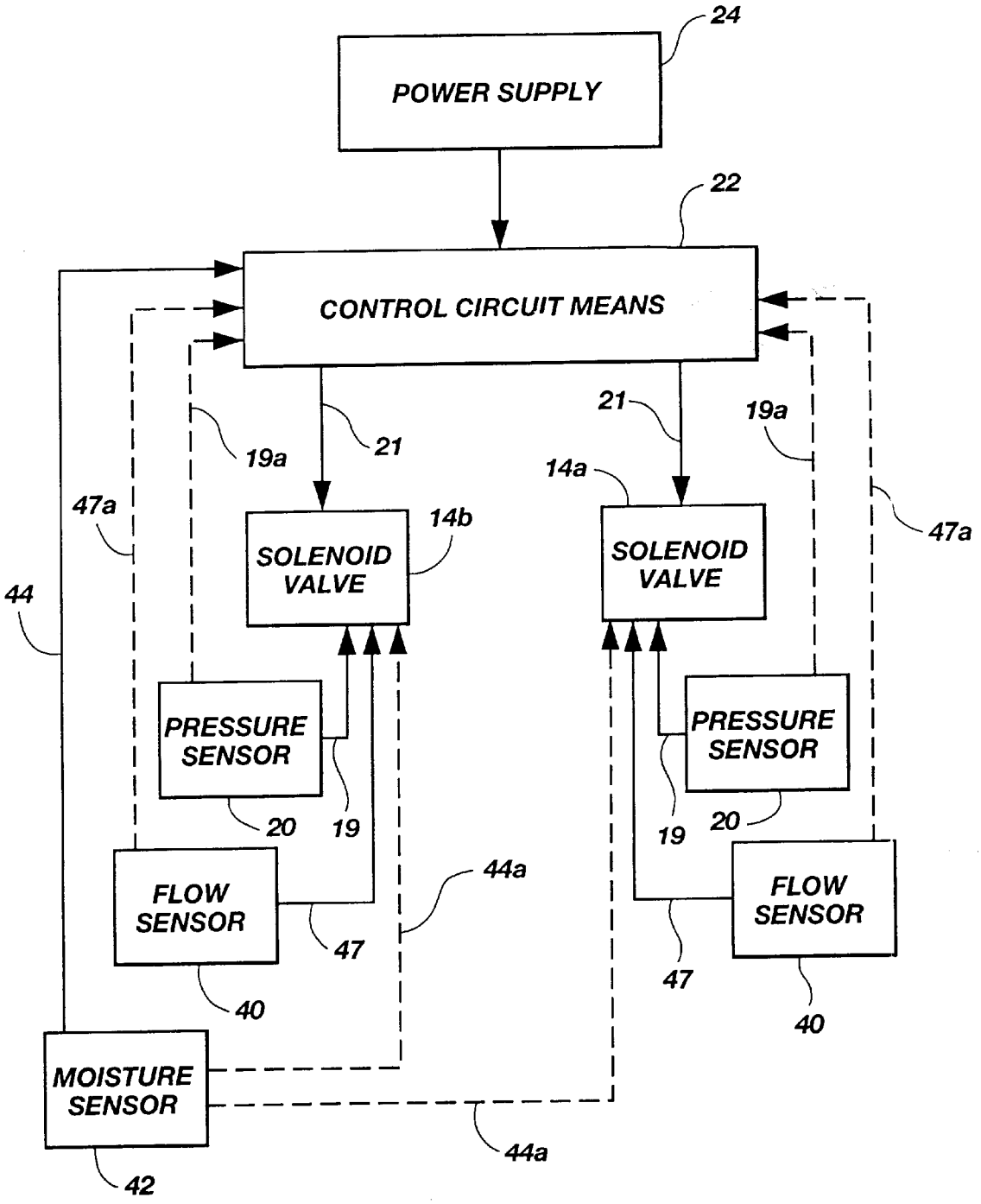
FIG. 2 is a block diagram illustrating one of many possible electrical circuit arrangements used to enable the present invention.

Referring now to FIG. 2, there is shown one of many electrical circuit arrangements necessary to enable the system 10. Sophisticated circuitry, programming techniques and undue experimentation are not necessary to enable the system 10, and any circuitry arrangement capable of enabling the system 10 which would occur to one of ordinary skill in possession of this disclosure is within the scope of the present invention.

As indicated by leads 19 in FIG. 2, the pressure sensors 20 preferably include their own microcontroller, complete with input circuitry and output drivers, and are electrically connected directly to the valves 14 by the leads 19. Alternatively, the pressure sensors 20 may be designed without input circuitry or output drivers and would be operated in connection with the control circuit means 22, and as such would be connected directly to the control circuit means 22 via leads 19*a* (represented in phantom line), and thus indirectly connected to the valves 14. Similarly, the flow sensors 40 are electrically connected directly to the valves 14 via leads 47 as shown, but may alternatively be connected directly to the control circuit means 22 as indicated by the phantom lead lines 47*a* and thus indirectly connected to the valves 14. The moisture sensor 42 is connected directly to the control circuit means 22 via lead 44, or alternatively connected directly to the valves 14*a* and 14*b* via leads 44*a*.

In accordance with the alternative circuit embodiments described above and other equivalent circuit embodiments which might be devised by those of ordinary skill, it is to be understood that the flow sensors 40 may be described broadly as including means for producing first and second electrical signals which are received by the valves 14*a* and 14*b*. Such a definition is to be taken to include the flow sensors 40 being connected directly to the valves 14*a* and 14*b* via leads 47, or indirectly via leads 47*a* which connect to the control circuit means 22.

In other words, the flow sensors 40 produce signals which are received in a broad sense by the valves 14*a* and 14*b*, either directly, or by being passed through the control circuit means 22 which produces an output signal based upon the signals produced by the sensors 40 but which are technically not those same physical signals. Even so, either scenario is covered by language which states that the flow sensors 40 produces signals which are received by the valves 14*a* and 14*b*, regardless of whether the signals produced by the flow sensors 40 are directly received or merely serve as the basis for final output signals produced by the control circuit means 22. This same broad concept of signals being produced and received also applies to signals produced by the pressure sensors 20 and the moisture sensor 42.

In accordance with the disclosure set forth above, a preferred method for reducing flooding risk in buildings posed by appliances such as the washing machine 30, which is disposed in fluidic communication with pipes 16 and 18 via intercoupling fluid conduits such as hoses 32, such that a fluid movement path extends sequentially from the pipes through the intercoupling conduits and into the appliance, comprises the steps of:

(a) producing first and second electrical signals responsive to activation and deactivation of the appliance, respectively; and (b) releasing and blocking fluid flow along the fluid movement path at a location upstream from the appliance and intercoupling conduit, and thus externally of said appliance and intercoupling conduit, responsive to said first and second electrical signals, respectively.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements which may be achieved by those having ordinary skill in the art.

What is claimed is:

1. A method for reducing flooding risk in buildings posed by appliances such as clothes washing machines, dish washing machines or other fluid-intake machines disposed in fluidic communication with a piping system of the building via at least one intercoupling fluid conduit, such that a fluid movement path extends sequentially from the piping system through the intercoupling conduit and into the appliance, said method comprising the steps of:

(a) producing first and second electrical signals responsive to activation and deactivation of the appliance, respectively; and (b) releasing and blocking fluid flow along the fluid movement path at a location within the piping system of the building and upstream from the appliance and intercoupling conduit, and thus externally of said appliance and intercoupling conduit, responsive to said first and second electrical signals, respectively.

2. A control valve system comprising:

a first valve means connected within a pipe system of a building for blocking and releasing fluid flow in said pipe system as part of a serial flowpath that is established when a conduit becomes fluidly connected (i) at a first end thereof in communication with said pipe system of the building and (ii) at an opposing, second end thereof in communication with a second valve means that is disposed in an electrical household appliance, such that said first valve means and said second valve means reside fluidly in series on opposite sides of the conduit;

control circuit means attachable to the electrical household appliance and being responsive to electron flow in said appliance for actuating the first valve means and the second valve means responsive to electrical signals produced by said appliance, such that said first valve means and said second valve means are thereby actuated in response to said electrical signals from the electrical household appliance.

3. The control valve system as defined in claim 2, wherein the control circuit means comprises means for (i) substantially simultaneously closing the first valve means and the second valve means responsive to an absence of electron flow in the electrical household appliance, and (ii) substantially simultaneously opening the first valve means and the second valve means responsive to a presence of electron flow in the electrical household appliance.

4. A control valve system comprising: said fluid passages, said electrical signals including first and first valve means connected within a pipe system of a building for blocking and releasing fluid flow in said pipe system as part of a serial flowpath that is established when a conduit becomes fluidly connected at a first end thereof to said pipe system and at an opposing, second end thereof to a second valve means that is disposed in an electrical household appliance, such that said first valve means resides upstream from said conduit and said second valve means resides downstream from said conduit with said first valve means and said second valve means also being in fluid communication with said conduit as part of the serial flowpath; and control circuit means attachable to the electrical household appliance and being responsive to electron flow in said appliance for actuating the first valve means and the second valve means responsive to electrical signals produced by said appliance, such that said first valve means and said second valve means are thereby actuated in response to said electrical signals from the electrical household appliance to thereby (i) block said conduit from exposure to fluid pressure in the pipe system when the first valve means is closed, and (ii) expose said conduit to fluid pressure in the pipe system when the first valve means is open.

5. The control valve system as defined in claim 1, wherein the control circuit means comprises means for (i) substantially simultaneously closing the first valve means and the second valve means responsive to an absence of electron flow in the electrical household appliance, and (ii) substantially simultaneously opening the first valve means and the second valve means responsive to a presence of electron flow in the electrical household appliance.

6. The control valve system as defined in claim 4, further comprising:

moisture sensor means for producing a first electrical signal representing a presence of moisture and conveying said signal to the control circuit means; and means for attaching the moisture sensor means to the electrical household appliance;

wherein the control circuit means further includes means responsive to the first electrical signal from the moisture sensor means for actuating the first valve means to a closed position to thereby prevent fluid from the pipe system of the building from flowing through the conduit responsive to said first electrical signal.

7. The control valve system as defined in claim 6, further comprising:

flow sensor means responsive to fluid flow in the conduit for producing electrical signals representing a fluid flow rate within said conduit, said signals including a first flow electrical signal representing a first flow rate within a predetermined flow range and a second flow electrical signal representing a second flow rate which is higher than the predetermined flow range;

wherein the control circuit means further includes means responsive to the second flow electrical signal for actuating the first valve means to a closed position to thereby prevent fluid from the pipe system of the building from flowing through the conduit responsive to said second flow electrical signal.

* * * * *